US006903714B2

(12) United States Patent
Tobiya

(10) Patent No.: US 6,903,714 B2
(45) Date of Patent: Jun. 7, 2005

(54) GRAY LEVEL CONVERSION METHOD AND DISPLAY DEVICE

(75) Inventor: Akira Tobiya, Tokyo (JP)

(73) Assignee: NEC-Mitsubishi Electric Visual Systems Corporation, Tokyo (JP)

( * ) Notice: Subject to any disclaimer, the term of this patent is extended or adjusted under 35 U.S.C. 154(b) by 203 days.

(21) Appl. No.: 09/882,029

(22) Filed: Jun. 18, 2001

(65) Prior Publication Data

US 2002/0036646 A1 Mar. 28, 2002

(30) Foreign Application Priority Data

Sep. 22, 2000 (JP) ..... P2000-288037

(51) Int. Cl.[7] ..... G09G 3/36
(52) U.S. Cl. ..... 345/89; 345/690; 345/207
(58) Field of Search ..... 345/89, 102, 77, 345/211, 204, 207, 690

(56) References Cited

U.S. PATENT DOCUMENTS

| | | | | |
|---|---|---|---|---|
| 4,952,917 A | * | 8/1990 | Yabuuchi | 340/703 |
| 6,020,869 A | | 2/2000 | Sasaki et al. | |
| 6,072,452 A | * | 6/2000 | Worley, III et al. | 345/89 |
| 6,275,209 B1 | * | 8/2001 | Yamamoto | 345/95 |
| 6,300,931 B1 | * | 10/2001 | Someya et al. | 345/102 |
| 6,459,416 B1 | | 10/2002 | Sasaki et al. | |

FOREIGN PATENT DOCUMENTS

| | | |
|---|---|---|
| JP | 7-333582 A | 12/1995 |
| JP | 7-334117 A | 12/1995 |
| JP | 7-334118 A | 12/1995 |
| JP | 8-54860 A | 2/1996 |
| JP | A9288468 | 11/1997 |
| KR | 2001-002261 A | 1/2001 |
| TW | 294807 | 1/1997 |

* cited by examiner

*Primary Examiner*—Regina Liang
*Assistant Examiner*—Jennifer T Nguyen
(74) *Attorney, Agent, or Firm*—Birch, Stewart, Kolasch & Birch, LLP

(57) ABSTRACT

In order to correct the gray level of a liquid crystal display (100), based upon a control signal (21) from a computer (2) for setting an LUT in the liquid crystal display (100), a signal source (3) generates a group of analog RGB signals (11) having values corresponding to various gradients, and gives these to an analog/digital converter (4). Moreover, a luminance meter (1) measures a gray level, for example, the luminance (14), displayed by a liquid crystal display panel (6). Data (15) corresponding to the luminance (14) measured by the luminance meter (1) is given to a computer (2). The computer (2) compares values of the group of RGB signals (11) outputted by the signal source (3) and the value of the data (15), and stores the resulting conversion characteristic (16) in an LUT memory means (5). The application of a rewritable memory, such as a RAM and an EEPROM, as the LUT memory means (5) makes it possible to cancel individual differences in the display characteristic of the display panel, and consequently to obtain a desired gray level. Thus, the relationship between the input signal and the gray level so as to have a desired characteristic is obtained.

7 Claims, 5 Drawing Sheets

GRAY LEVEL CONVERSION METHOD AND DISPLAY DEVICE

BACKGROUND OF THE INVENTION

1. Field of the Invention

The present invention relates to a technique for controlling the gray level of an image that is displayed in response to an input signal.

2. Description of the Background Art

A display device for displaying images (including all visual information such as characters and symbols) is allowed to display an image with a gray level corresponding to the value of a signal inputted to the display device. The gray level relates to, for example, luminance or light transmittance. Here, the value of the signal inputted to the display device and the value of the gray level associate with a characteristic inherent to the display device (also referred to γ-characteristic: hereinafter, referred to as "display characteristic"). Therefore, in a display apparatus, provided with a display device, not a signal inputted to the display device (hereinafter, referred to as "input signal") itself, but a conversion signal obtained by converting the input signal by using another characteristic (hereinafter, referred to as "correction characteristic") is given, to the display device in order to allow the display device to display with a gray level that has a linear relationship with the value of the input signal.

Since there are variations in the display characteristic depending on display devices, the correction characteristic needs to be set for each of the display devices, and a look-up table (hereinafter, referred to as "LUT") is used so as to make the input signal and the conversion signal associated with each other. Here, a storage device such as a memory in which the look-up table is stored is installed in the display apparatus as a conversion section together with the display device.

FIG. 8 is a graph that approximates the display characteristic. The value of a conversion signal is plotted on the axis of abscissa x and the value of a gray level is plotted on the axis of ordinate y. In order to approximate the display characteristic, the values of four conversion signals, x=P1, P2, R1, R2, are given to the display device, and the corresponding values of gray level y=Q1, Q2, S1, S2 are measured.

Here, in the range of x=0 to P2, the display characteristic is approximated by a function f(x), and in the range of x=P2 to R1, the display characteristic is approximated by a function g(x). In the range from x R1 to the maximum value of the conversion signal, the display characteristic is approximated by a function h(x). All of these functions f(x), g(x), and h(x) are, for example, functions containing logarithmic functions, and respectively determined by: (x, f(x))=(P1, Q1), (P2, Q2), (x, g(x))=(P2, Q2), (R1, S1), (x, h(x))=(R1, S1), (R2, S2).

FIG. 9 is a graph that shows a correction characteristic. The value of an input signal is plotted on the axis of abscissa x and the value of a conversion signal is plotted on the axis of ordinate y. In this case, the input signal and the conversion signal are both provided with 8 bit tones ($2^8$=256 gradient). Here, the input signal and the conversion signal are property conformed to each other in their ranges of variations, and with respect to correction characteristics, in the case of x=0 to Q2, $f^{-1}(x)$ is set, in the case of x=Q2 to S1, $g^{-1}(x)$ is set, and in the case of x=S1 to the maximum value of the input signal, $h^{-1}(x)$ is set, respectively. Here, the symbol "$^{-1}$" represents the inverse function.

Therefore, by using an LUT having the correction characteristic shown in FIG. 9, the input signal is converted to the conversion signal, and based upon the resulting conversion signal, the display device executes a display with the gray level in accordance with the display characteristic; thus, the display is carried out with the gray level that has a linear relationship with the input signal. For example, such a technique has been disclosed by Japanese Patent Application Laid-Open No. 9-288468(1997).

However, in the technique proposed by Japanese Patent Application Laid-Open No. 9-288468(1997), the display characteristic is approximated by a function, and the inverse function to the function is calculated so as to provide a linear-type display characteristic. Then, this is multiplied by a coefficient for canceling a correction (hereinafter, referred to as "CRT-use y correction") preliminarily applied to a video signal so as to correct the display characteristic of a cathode ray tube (CRT), if necessary, so as to set the LUT of the correction characteristic.

Therefore, only the LUT for setting the following relationships to a linear relationship has been provided: the relationship between the input signal and the gray level that is made associated with each other through the conversion signal or the relationship between the set value of the video signal prior to being applied the CRT-use γ correction and the gray level.

SUMMARY OF THE INVENTION

A method according to first aspect of the present invention is a gray level conversion method that is applied to a device having a conversion section for obtaining a conversion signal by applying a conversion process to an input signal in accordance with a first characteristic and a display element for executing a display with a gray level in accordance with a second characteristic with respect to the value of the conversion signal, wherein the first characteristic is set by using a second characteristic and a third characteristic with respect to the gray level in association with the input signal. Here, the method comprises the steps of (a) finding a value of the gray level given by the third characteristic in response to the value of the input signal (b) finding a value of the conversion signal that gives the value of the gray level found at step (a) in accordance with the second characteristic, (c) setting the first characteristic by making the value of the input signal set at step (a) and the value of the conversion signal found at step (b) associated with each other.

The gray level conversion method according to second aspect of the present invention is characterized in that the third characteristic is variable.

The method according to third aspect of the present invention, which relates to second aspect, further comprises the step of: (d) prior to step (b), finding the second characteristic by adopting a characteristic that makes the input signal and the conversion signal virtually equal to each other as the first characteristic.

The method according to fourth aspect of the present invention, which relates to the third aspect, is characterized in that the value of the input signal is a digital value in the step (d).

The gray level conversion method according to fifth aspect of the present invention, which relates to the first aspect, is characterized in that the display device is a liquid crystal display.

The gray level conversion method according to sixth aspect of the present invention, which relates to the fifth aspect, is characterized in that the gray level is luminance.

A device according to seventh aspect of the present invention is a display device having a conversion section for obtaining a conversion signal by applying a conversion process to an input signal in accordance with a first characteristic and a display element for executing a display with a gray level in accordance with a second characteristic with respect to the value of the conversion signal, wherein the first characteristic is externally found and set in the conversion section based upon the second characteristic and a third characteristic with respect to the gray level in association with the input signal.

The device according to ninth aspect of the present invention, which relates to the eighth display device, is further provided with a control section for generating a digital signal, and the digital signal and the input signal are supplied to the conversion section exclusively.

In accordance with the gray level conversion method of first aspect and the display device of seventh aspect in the present invention, even when there are variations in the second characteristic in a display device, based upon calculations on the first characteristic, the display element is allowed to display with a gray level in accordance with a desired third characteristic with respect to an input signal. Here, the desired third characteristic can be preferably set.

In accordance with the gray level conversion method according to the third aspect of the present invention, the second characteristic can be found independently for each display device.

In accordance with the gray level conversion method according to fourth aspect and the display device according to ninth aspect in the present invention, the second characteristic can be obtained more accurately so that the first characteristic is found with high precision.

The present invention has been devised to solve the above-mentioned problem, and its objective is to provide a technique by which a conversion characteristic for obtaining a conversion signal from an input signal is set so that the relationship between the input signal and the gray level can be set to an optional, desired characteristic (hereinafter, referred to "desirable characteristic").

The first through third characteristics correspond to "conversion characteristic", "display characteristic" and "desirable characteristic", respectively.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
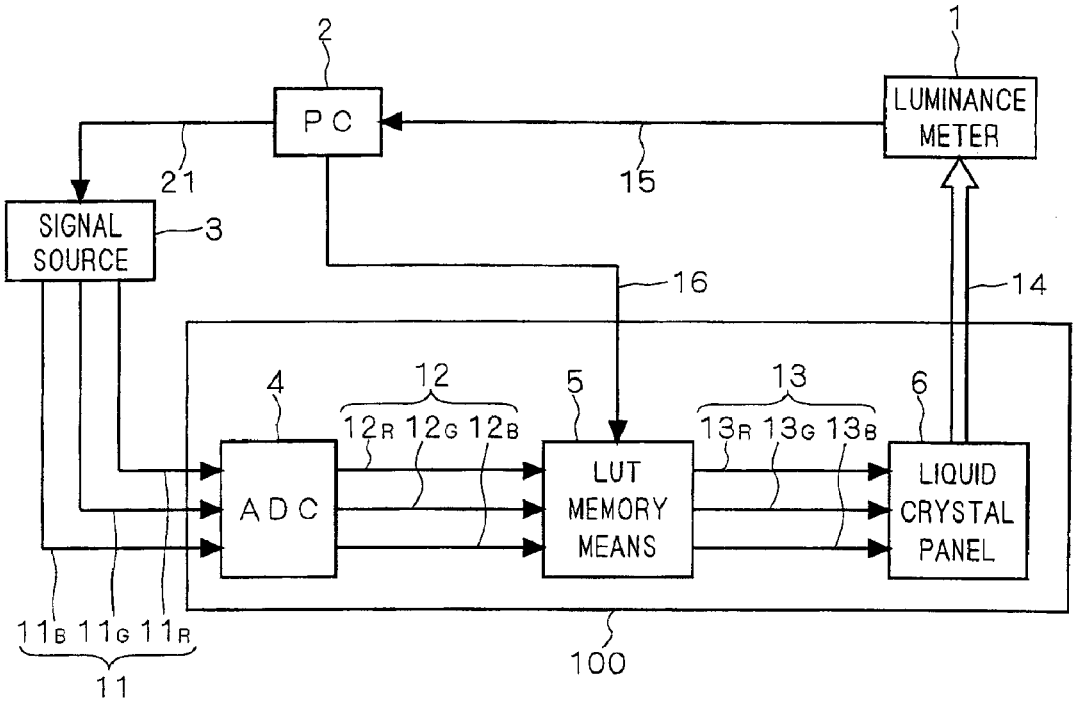
FIG. 1 is a block diagram that shows a construction of a display characteristic correction system in accordance with a first preferred embodiment of the present invention.

FIG. 1 is a block diagram that shows a construction of a display characteristic correction system in accordance with the first preferred embodiment of the present invention. The display characteristic correction system is provided with a liquid crystal display 100, and a means for correcting the gray level of the liquid crystal display 100.

In the liquid crystal display 100, an analog/digital converter (ADC) 4 carries out an analog/digital conversion on a group of analog RGB signals 11 inputted thereto from outside, and generates a group of digital RGB signals 12. Then, an LUT memory means 5 carries out a conversion on the group of RGB signals 12 based upon a predetermined conversion characteristic, and generates a group of digital RGB signals 13 as conversion signals. Further, the liquid crystal display panel 6, which serves as a display element, receives the group of RGB signals 13, and carries out a display with a gray level, for example, a luminance, based upon an inherent display characteristic. The group of RGB signals 11 are composed of signals $\mathbf{11}_R$, $\mathbf{11}_G$ and $\mathbf{11}_B$, the group of RGB signals 12 are composed of signals $\mathbf{12}_R$, $\mathbf{12}_G$ and $\mathbf{12}_B$, and the group of RGB signals 13 are composed of signals $\mathbf{13}_R$, $\mathbf{13}_G$ and $\mathbf{13}_B$. Here, all the signals $\mathbf{11}_R$, $\mathbf{12}_R$ and $\mathbf{13}_R$ correspond to red signals (R), all the signals $\mathbf{11}_G$, $\mathbf{12}_G$ and $\mathbf{13}_G$ correspond to green signals (G), and all the signals $\mathbf{11}_B$, $\mathbf{12}_B$ and $\mathbf{13}_B$ correspond to blue signals (B).

The respective signals constituting the groups of RGB signals 12, 13 may be composed of any number of bits; however, in the present preferred embodiment, an explanation will be given of a case in which each of them is composed of 8 bits by which gradients (or tones) of 0 to 255 can be obtained. Moreover, not limited to the liquid crystal display element, another display element, such as a CRT, may be used.

In order to correct the gray level of the liquid crystal display 100, a signal source 3 generates a group of analog RGB signals 11 corresponding to various gradients, based upon a control signal 21 from a computer (for example, a personal computer: PC) 2 for setting the LUT in the liquid crystal display 100, and gives them to the analog/digital converter 4. Moreover, a luminance meter 1 measures the gray level displayed by the liquid crystal panel 6, for example, the luminance 14. Data 15 corresponding to the luminance 14 thus measured by the luminance meter 1 is supplied to the computer 2.

The computer 2 compares the values of the group of RGB signals 11 outputted by the signal source 3 and the values of the data 15, and stores the resulting conversion characteristic 16 in the LUT memory means 5. More specifically, this process is realized by, for example, storing data corresponding to the value of the group of RGB signals 13 in addresses corresponding to the value of the group of RGB signals 12. The application of a rewritable memory such as a RAM and an EEPROM as the LUT memory means 5 makes it possible to cancel individual differences in the display characteristic of the liquid crystal panels 6, and consequently to obtain a desired gray level.

The following description will discuss a method of setting the conversion characteristic 16 by typically exemplifying the red color; however, in actual cases, the setting of the conversion characteristic 16 is also carried out on each of the green and blue colors individually.

Figure 2:
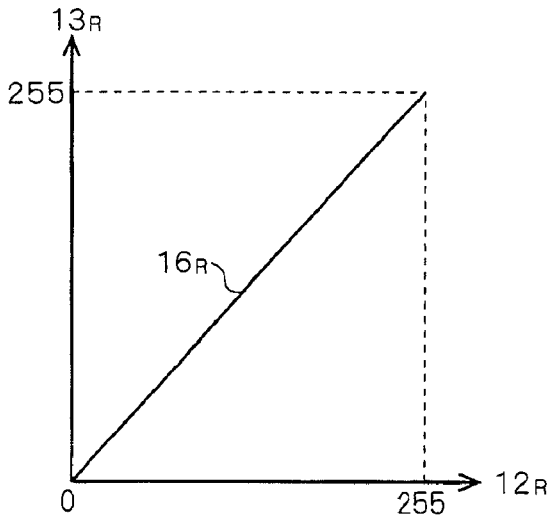
FIG. 2 is a graph that shows a conversion characteristic.

First, in order to find the display characteristic of the liquid crystal panel 6 individually, the computer 2 gives a conversion characteristic $\mathbf{16}_R$ to the LUT memory means 5 which allows the signal $\mathbf{12}_R$ and the signal $\mathbf{13}_R$ to have virtually the same value. FIG. 2 is a graph that shows a conversion characteristic $\mathbf{16}_R$. By storing such a conversion characteristic that exerts apparently no conversion process, it is possible to confirm the signal $\mathbf{13}_R$ serving as the conversion signal as if it were the signal $\mathbf{11}_R$ serving as the input signal in a digital format.

Next, in accordance with the control signal 21 from the computer 2, the signal $\mathbf{11}_R$ having various amplitudes is outputted from the signal source 3 to the analog/digital converter 4 of the liquid crystal display 100. Upon receipt of the signal $\mathbf{11}_R$, the analog/digital converter 4 subjects it to a quantization process with the greatest amplitude being set at 255 to generate a signal $\mathbf{12}_R$, and outputs the resulting signal to the LUT memory means 5. For example, if the amplitude of the signal $\mathbf{11}_R$ is an amplitude corresponding to 50/255 of the maximum amplitude of the video signal, the signal $\mathbf{12}_R$ has a gradient of 50.

As described above, since the LUT memory means 5 stores the conversion characteristic $\mathbf{16}_R$ that allows the signals $\mathbf{12}_R$ and $\mathbf{13}_R$ to have the same value, the value of the signal $\mathbf{12}_R$, that is, digital data indicating the value 50 for the above example, is inputted to the liquid crystal panel 6. Therefore, the liquid crystal panel 6 emits light with a luminance corresponding to the value of the signal $\mathbf{12}_R$. The luminance meter 1 measures the luminance 14 at this time, and sends data 15 indicating the results to the computer 2.

Figure 3:
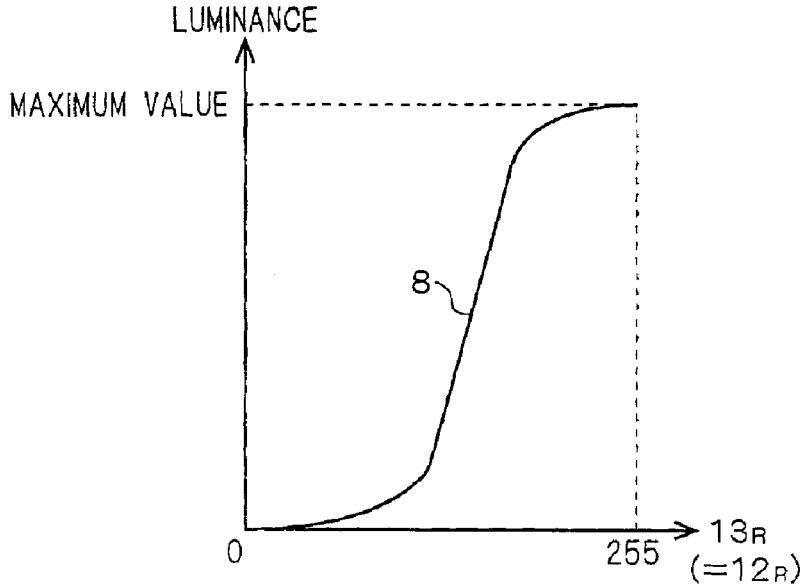
FIG. 3 is a graph that shows one example of a display characteristic of a liquid crystal panel.

The above-mentioned processes are carried out on all the values 0 to 255 of gradients, thereby finding the display characteristic of the red color of the liquid crystal panel. FIG. 3 is a graph that shows one example of a display characteristic 8 of the liquid crystal panel 6.

Here, in order to find the display characteristic of the liquid crystal panel 6, it is not necessary to measure the gray level with respect to all the gradients that the signal $\mathbf{12}_R$ is allowed to take. For example, the gradients that the signal $\mathbf{12}_R$ is allowed to take may be properly selected, and the luminance thereof is measured, and the relationship between the signal $\mathbf{11}_R$ and the luminance may be obtained with respect to the number of gradients less than all the gradients. On the computer 2, an interpolation process, such as Spline interpolation, is carried out to calculate data indicating the relationship between all the values of gradients and the gray level, thereby making it possible to find the display characteristic of the liquid crystal panel 6.

Figure 4:
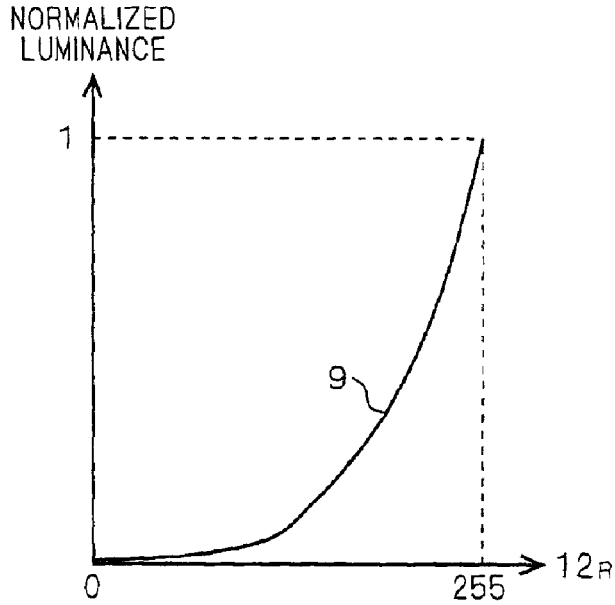
FIG. 4 is a graph that shows one example of a desired characteristic.

Once the display characteristic has been obtained, next is set a conversion characteristic. Although the signal $\mathbf{11}_R$, which is the input signal, is an analog signal, it is possible to recognize the signal $\mathbf{12}_R$ formed by digitizing this as the renewed input signal. Here, suppose that a desired characteristic that a desired gray level, for example, the luminance to be displayed by the signal $\mathbf{12}_R$ is allowed to take, has been given to the computer 2. FIG. 4 is a graph that shows one example of the desired characteristic in which the luminance is normalized. Here, the characteristic of the luminance thus normalized with respect to the input signal is referred to as "normalized target luminance characteristic". The normalized target luminance characteristic 9 may have any characteristic as long as the maximum luminance is normalized to 1. The normalized target luminance characteristic 9 can be readily altered on the computer 2.

Figure 5:
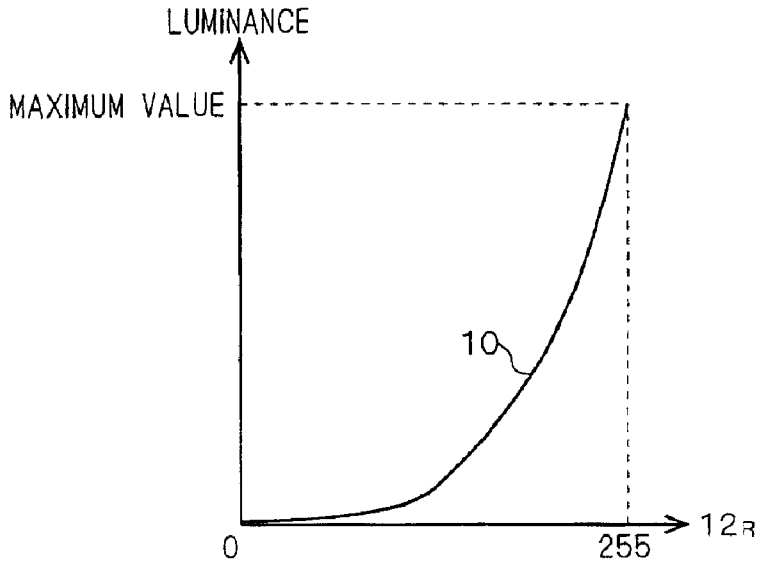
FIG. 5 is a graph that exemplifies an actual luminance target characteristic.

FIG. 5 is a graph that exemplifies an actual luminance target characteristic 10 obtained by multiplying the normal target luminance characteristic 9 by the maximum luminance. By comparing the actual luminance target characteristic 10 with the actually measured display characteristic 8 of the liquid crystal panel 6, it is possible to obtain a conversion characteristic that makes the display characteristic covering the entire liquid crystal display 100 coincident with the actual luminance target characteristic 10.

Figure 6:
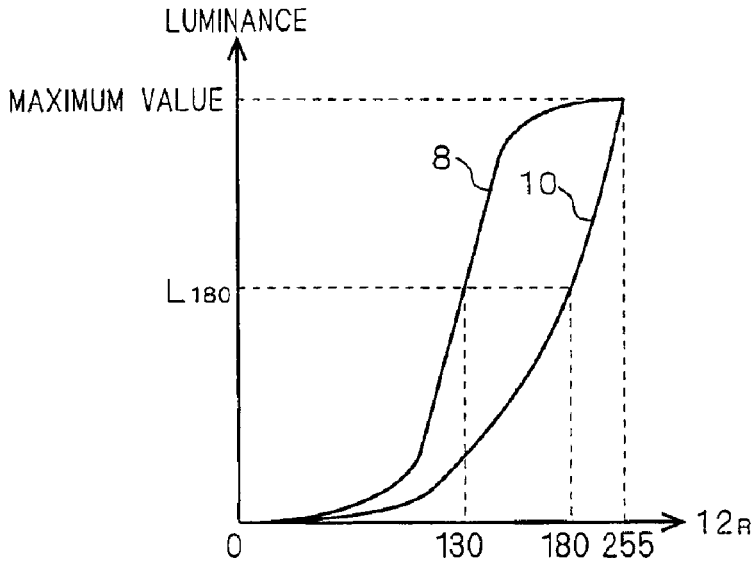
FIG. 6 is a graph that shows a display characteristic correction in accordance with the first preferred embodiment.

FIG. 6 is a graph that shows a method for obtaining a conversion characteristic from the display characteristic 8 and the actual luminance target characteristic 10. For example, supposing that the display characteristic of the liquid crystal panel 6 is in conformity with the actual luminance target characteristic 10, a signal $\mathbf{11}_R$ having a value of gradient 180 is supplied, the luminance of the liquid crystal panel 6 is represented by $L_{180}$. In this case, when the value of gradient of the signal $\mathbf{13}_R$, which gives the luminance $L_{180}$ in accordance with the display characteristic 8 that is the actual display characteristic of the liquid crystal panel, is found, a value of gradient 130 is obtained. Accordingly, in the case when the value of the input signal is equivalent to a value of the gradient 180, a conversion process which sets the value of the conversion signal equivalent to a value of the gradient 130, is obtained. This process is carried out by the computer 2 with respect to all the values of gradients so as to obtain a conversion characteristic 16 with respect to the red color. In the same manner, conversion characteristics 16 of blue and green colors. The gradients that the signal $\mathbf{13}_R$ is allowed to take may be properly selected so that the conversion characteristic 16 may be obtained by using the number of gradients less than all the number thereof.

In the above-mentioned explanation, the conversion characteristic 16 is obtained by multiplying the normalized target luminance characteristic 9 by the maximum luminance of the display characteristic 8 of the liquid crystal panel 6. However, the display characteristic 8 of the liquid crystal panel 6 may be divided by the maximum luminance, and the result may be compared with the normalized target luminance characteristic 9 so as to obtain the conversion characteristic 16.

As described above, in the present preferred embodiment, the conversion characteristic is found based upon the display characteristic and the desired characteristic; therefore, even if there are variations depending on respective liquid crystal panels 6, it is possible to obtain not only the linear-type relationship, but also a predetermined characteristic, and further, a variable desired characteristic, such as a characteristic in which the contrast is emphasized, and a characteristic in which noise is omitted from display at low-tone.

Second Preferred Embodiment

Figure 7:
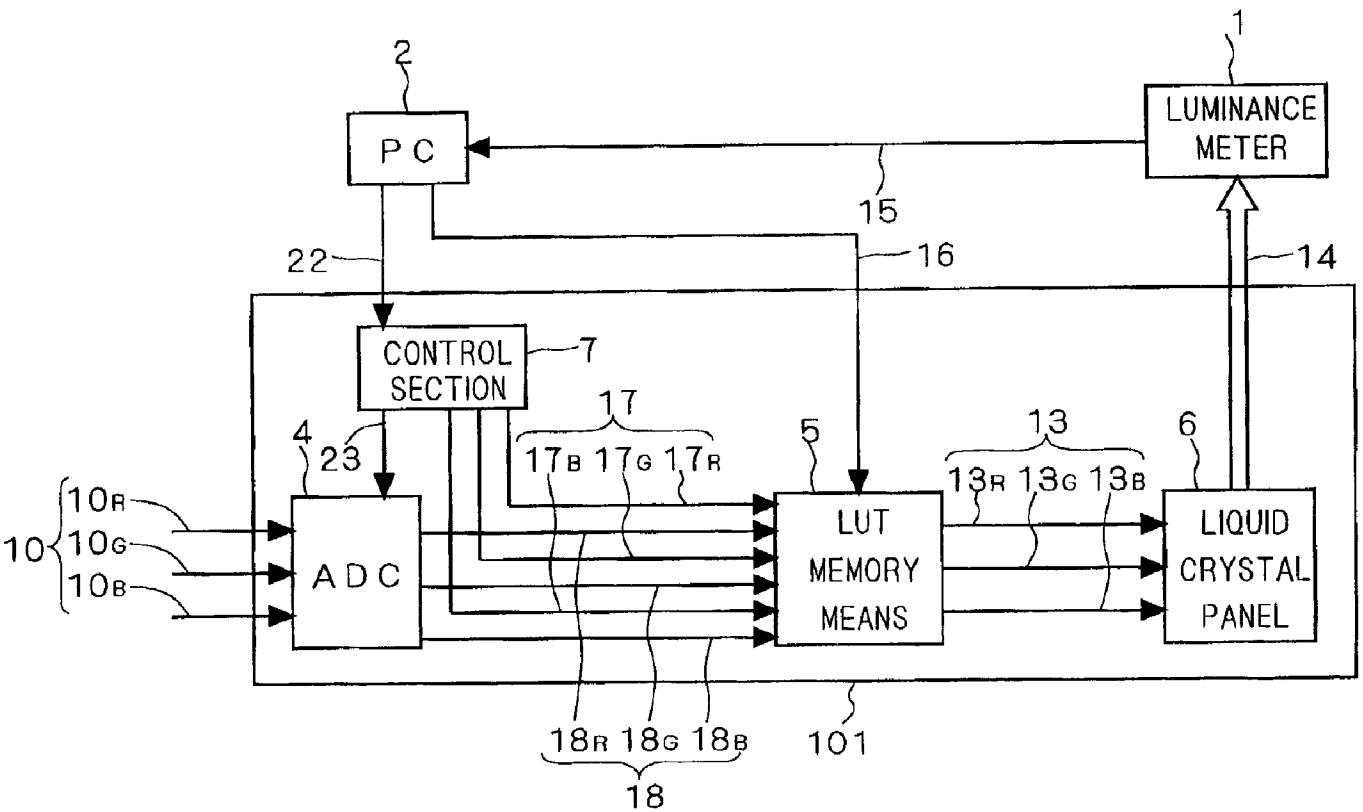
FIG. 7 is a block diagram that shows a construction of a display characteristic correction system in accordance with a second preferred embodiment of the present invention.
Figure 8:
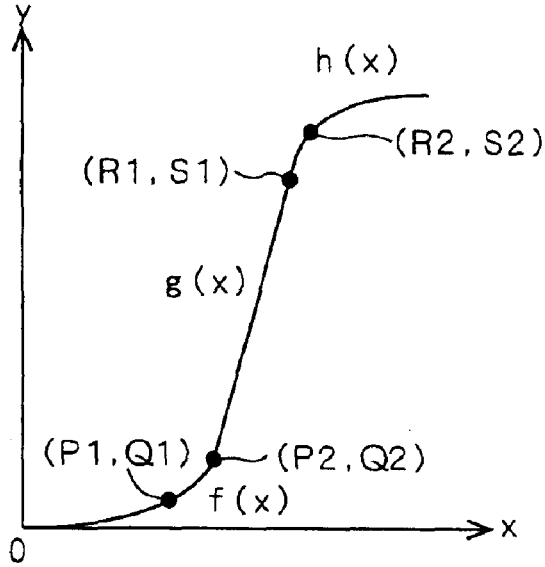
FIG. 8 CONVENTIONAL ART
FIG. 8 is a graph that approximates the display characteristic in a conventional technique.
Figure 9:
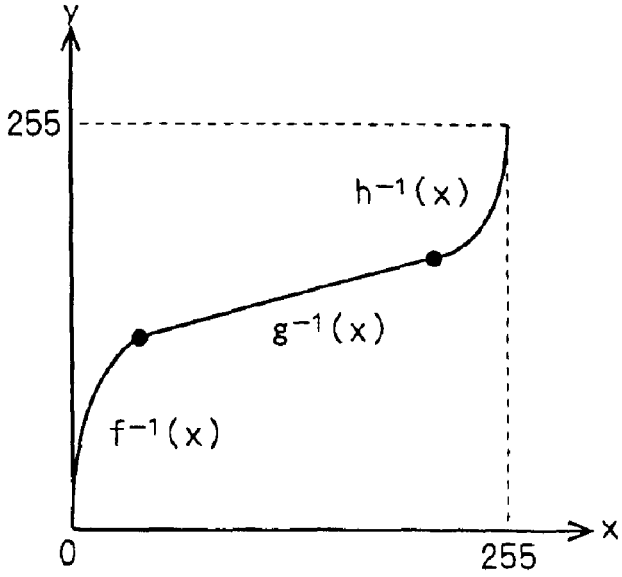
FIG. 9 CONVENTIONAL ART
FIG. 9 is a graph that approximates the correction characteristic in the conventional technique.

FIG. 7 is a block diagram that shows a construction of a display characteristic correction system in accordance with the second preferred embodiment of the present invention. The display characteristic correction system is provided with a liquid crystal display 101 and a means for correcting the gray level of the liquid crystal display 101.

The liquid crystal display 101 has the same structure as the liquid crystal display 100 except that a control section 7 is added. The control section 7 outputs a group of digital RGB signals 17 having gradients specified by a control signal 22 from the computer 2 to the LUT memory means 5. This process controls the analog/digital conversion section 4 so as to stop its output. For example, when the group of RGB signals 10 that are analog video signals are inputted to the analog/digital conversion section 4, these are converted to a group of digital RGB signal group 18; however, in the case when the group of RGB signals 17 have been inputted to the LUT memory means 5, the group of RGB signals 18 are not inputted to the LUT memory means 5. Here, the signals $\mathbf{17}_R$, $\mathbf{17}_G$ and $\mathbf{17}_B$, constituting the group of RGB signals 17 are signals related to red, green and blue, and the same is true for the groups of RGB signals 10 and 18.

The operation relates to the setting of conversion characteristics is basically the same as the case indicated by the first preferred embodiment. However, with respect to means for correcting the gray level of the liquid crystal display 101, the present preferred embodiment only requires the luminance meter 1 and the computer 2, and does not require the signal source 3. This is because the group of digital signals 17 to be supplied to the LUT memory means 5 at the time of luminance measurements are generated by the control section 7. In the case when the liquid crystal display 101 is normally used, a group of signals 18 based upon a group of externally supplied signals 10 are given to the LUT memory means 5.

As described above, in the present preferred embodiment, upon measuring the luminance so as to find the display characteristic that the liquid crystal panel 6 possesses, the input signal in the digital format is adopted; therefore, it is possible to eliminate errors of analog signals of their own generated based upon control of the computer 2, and parasitic noise of these and conversion errors (for example, errors in quantization) in the analog/digital conversion section 4. Therefore, the display characteristic of the liquid crystal panel 6 can be found more accurately, and it becomes possible to carry out calculations on the conversion characteristic more precisely, and consequently to obtain a desired characteristic with high precision.

While the invention has been shown and described in detail, the foregoing description is in all aspects illustrative and not restrictive. It is therefore understood that numerous other modifications and variations can be devised without departing from the scope of the invention.

What is claimed is:

1. A gray level conversion method, applied to a device comprising:

a conversion section for obtaining a conversion signal by applying a conversion process to an input signal in accordance with a conversion characteristic; and a display element for executing a display with a gray level in accordance with a display characteristic with respect to a value of said conversion signal, wherein said conversion characteristic is set by a processing device, which uses said display characteristic and a desired characteristic with respect to said gray level in association with said input signal, wherein said desired characteristic is obtained by the processing device, said method comprising the steps of:

(a) finding a value of said gray level given by said desired characteristic in response to a set value of the input signal;

(b) finding said display characteristic using said conversion signal obtained from said conversion section by adopting, as said conversion characteristic, a characteristic that makes said input signal and said conversion signal virtually equal to each other;

(c) finding the value of said conversion signal that gives said value of said gray level found at said step (a) in accordance with said display characteristic;

(d) setting said conversion characteristic based on a relationship between said value of said input signal set at said step (a) and the value of the conversion signal found at said step (c).

2. The gray level conversion method according to claim 1, wherein said value of said input signal is a digital value in said step (d).

3. The gray level conversion method according to claim 1, wherein said display device is a liquid crystal display.

4. The gray level conversion method according to claim 3, wherein said gray level is luminance.

5. A display device comprising:

a processing device for obtaining a desired characteristic;

a conversion section for obtaining a conversion signal by applying a conversion process to a supplied signal in accordance with a first characteristic, said supplied signal being one of an input signal and a digital signal;

a display element for executing a display with a gray level in accordance with a second characteristic with respect to a value of the conversion signal; and a control section for generating said digital signal, said digital signal and said input signal being supplied to said conversion section exclusively from one another, wherein said processing device sets the conversion characteristic is set in said conversion section based upon said display characteristic and conversion characteristic with respect to said gray level in association with said supplied signal, wherein said display characteristic is determined by adopting, as said conversion characteristic, a characteristic that makes said supplied signal and said conversion signal virtually equal.

6. The display device according to claim 5, wherein said display device is a liquid crystal display.

7. The display device according to claim 6, wherein said gray level is luminance.

* * * * *